United States Patent [19]

Seyama et al.

[11] Patent Number: 4,985,393

[45] Date of Patent: Jan. 15, 1991

[54] HEAT SENSITIVE RECORDING MATERIAL

[75] Inventors: Fumio Seyama, Osaka; Tetsuo Tsuchida, Takarazuka; Mitsuru Kondo, Hyogo, all of Japan

[73] Assignee: Kanzaki Paper Manufacturing Co., Ltd., Tokyo, Japan

[21] Appl. No.: 448,419

[22] Filed: Dec. 11, 1989

[30] Foreign Application Priority Data

Dec. 12, 1988 [JP] Japan ..... 63-313269
Jan. 11, 1989 [JP] Japan ..... 1-4132

[51] Int. Cl.[5] ..... B41M 5/18

[52] U.S. Cl. ..... 503/216; 427/150; 503/225

[58] Field of Search ..... 427/150–152; 503/216, 217, 225

[56] References Cited

U.S. PATENT DOCUMENTS 4,502,068 2/1985 Taniguchi et al. ..... 346/216

*Primary Examiner*—Bruce H. Hess

*Attorney, Agent, or Firm*—Armstrong, Nikaido, Marmelstein, Kubovcik & Murray

[57] ABSTRACT

A heat sensitive recording material comprising a substrate and a heat sensitive recording layer thereon incorporating a colorless or light-colored basic dye and a color acceptor reactive with the dye to form a color when contacted therewith, the recording material being characterized in that, as the color acceptor is used at least one compound of the formula [I]

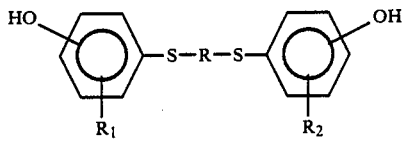

(I)

wherein R is an alkylene group having at least one bond selected from the group consisting of ester bond and amido bond in the main chain, $R_1$ and $R_2$ are each hydrogen atom, alkyl, cycloalkyl, alkenyl, alkoxyl, hydroxyl or halogen atom.

10 Claims, No Drawings

HEAT SENSITIVE RECORDING MATERIAL

The present invention relates to a heat sensitive recording material, and more particularly to a heat sensitive recording material which has an excellent amenability to high-speed recording, and is excellent in preservability of the record images and free from decrease in whiteness of a background area.

Heat sensitive recording materials are well known which are adapted to produce record images by thermally contacting a colorless or light-colored basic dye with an organic or inorganic color acceptor for a color forming reaction.

With remarkable progress in heat sensitive recording systems in recent years, thermal facsimile systems, thermal printers, etc. are made operable at a high speed. For example, thermal facsimile systems produce a copy of A4 size within 10 seconds and thermal printers record at least 120 characters per second. For use with such high-speed hardware, heat sensitive recording materials must meet the requirements of high-speed recording.

In order to make a heat sensitive recording material operable at a high speed, it is necessary to enhance a recording sensitivity of the recording material. However, the higher the sensitivity of the recording material, the more the recording material is apt to discolor (fogging) in background area of the recording material when preserved for a long time. Further, such a recording material is not sufficient in the preservability of the record images.

An object of the invention is to provide a heat sensitive recording material which is high in whiteness, excellent in high-speed recording amenability and preservability of the record images, and free from decrease in whiteness of a background area (white portion).

The above and other objects of the invention will become apparent from the following description.

The present invention provides a heat sensitive recording material comprising a substrate and a heat sensitive recording layer thereon incorporating a colorless or light-colored basic dye and a color acceptor reactive with the dye to form a color when contacted therewith, the recording material being characterized in that, as the color acceptor is used at least one compound of the formula [I]

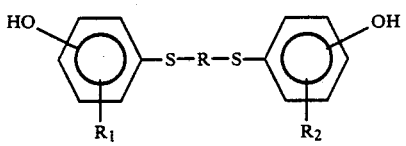

(I)

wherein R is an alkylene group having at least one bond selected from the group consisting of ester bond and amido bond in the main chain, $R_1$ and $R_2$ are each hydrogen atom, alkyl, cycloalkyl, alkenyl, alkoxyl, hydroxyl or halogen atom.

In the present invention, it is still remained to be clarified why the heat sensitive recording material which is excellent in high-speed recording amenability and preservability of the record images without causing fogging is obtained by use of the compound of the above formula [I]. It is presumed, however, that the compound of the formula [I] is insoluble in water and causes no fogging when the recording material is preserved at a high humidity circumstance, has a moderate melting point to exhibit high recording sensitivity and also causes no fogging when the recording material is preserved at a high temperature circumstance.

In the above formula [I], R has preferably 3 to 20 carbon atoms and more preferably 4 to 12 carbon atoms. $R_1$ and $R_2$ are each independently hydrogen atom, $C_{1\sim4}$ alkyl, $C_{5\sim10}$ cycloalkyl, $C_{3\sim8}$ alkenyl, $C_{1\sim4}$ alkoxy, hydroxyl, fluorine atom, chlorine atom or bromine atom, and more preferably hydrogen atom, methyl, ethyl, cyclohexyl, allyl, methoxy, ethoxy, hydroxyl or chlorine atom. Further, preferable is the compound in which hydroxyl groups are each in the para position to the sulfide bond, which is easily synthesized.

Examples of useful compounds of the formula [I] are as follows.

(4-Hydroxyphenylthio)acetic acid 2-(4-hydroxyphenylthio)ethyl ester (4-hydroxyphenylthio)acetic acid 3-(4-hydroxyphenylthio)propyl ester (4-hydroxyphenylthio)acetic acid 2-(4-hydroxyphenylthio)propyl ester (4-hydroxyphenylthio)acetic acid 1-methyl-2-(4-hydroxyphenylthio)ethyl ester (4-hydroxyphenylthio)acetic acid 4-(4-hydroxyphenylthio)butyl ester (4-hydroxyphenylthio)acetic acid 2-(4-hydroxy-3-methylphenylthio)ethyl ester (4-hydroxy-3-methylphenylthio)acetic acid 2-(4-hydroxyphenylthio)ethyl ester (4-hydroxy-3-methylphenylthio)acetic acid 2-(4-hydroxy-3-methylphenylthio)ethyl ester (4-hydroxy-3-methylphenylthio)acetic acid 3-(4-hydroxy-3-methylphenylthio)propyl ester (4-hydroxy-3-methoxyphenylthio)acetic acid 2-(4-hydroxy-3-methoxyphenylthio)ethyl ester (4-hydroxy-3-methoxyphenylthio)acetic acid 3-(4-hydroxy-3-methoxyphenylthio)propyl ester (4-hydroxy-3-allylphenylthio)acetic acid 2-(4-hydroxy-3-allylphenylthio)ethyl ester (4-hydroxy-3-chlorophenylthio)acetic acid 2-(4-hydroxy-3-chlorophenylthio)ethyl ester (4-hydroxy-3-chlorophenylthio)acetic acid 3-(4-hydroxy-3-chlorophenylthio)propyl ester (4-hydroxy-3-cyclohexylphenylthio)acetic acid 2-(4-hydroxy-3-cyclohexylphenylthio)ethyl ester (3,4-dihydroxyphenylthio)acetic acid 2-(3,4-dihydroxyphenylthio)ethyl ester (3,4-dihydroxyphenylthio)acetic acid 3-(3,4-dihydroxyphenylthio)propyl ester (4-hydroxyphenylthio)acetic acid 2-(2-hydroxyphenylthio)ethyl ester (2-hydroxyphenylthio)acetic acid 2-(4-hydroxyphenylthio)ethyl ester (2-hydroxyphenylthio)acetic acid 2-(2-hydroxyphenylthio)ethyl ester 2-(4-hydroxyphenylthio)propionic acid 2-(4-hydroxyphenylthio)ethyl ester 2-(4-hydroxyphenylthio)propionic acid 3-(4-hydroxyphenylthio)propyl ester 2-(4-hydroxy-3-methylphenylthio)propionic acid 2-(4-hydroxy-3-methylphenylthio)ethyl ester 2-(4-hydroxy-3-methylphenylthio)propionic acid 3-(4-hydroxy-3-methylphenylthio)propyl ester 2-(4-hydroxy-3-methoxyphenylthio)propionic acid 2-(4-hydroxy-3-methoxyphenylthio)ethyl ester 2-(4-hydroxy-3-chlorophenylthio)propionic acid 2-(4-hydroxy-3-chlorophenylthio)ethyl ester 2-(3,4-dihydroxyphenylthio)propionic acid 2-(3,4-dihydroxyphenylthio)ethyl ester
3-(4-hydroxyphenylthio)propionic acid 2-(4-hydroxyphenylthio)ethyl ester
3-(4-hydroxyphenylthio)propionic acid 3-(4-hydroxyphenylthio)propyl ester
3-(4-hydroxy-3-methylphenylthio)propionic acid 2-(4-hydroxy-3-methylphenylthio)ethyl ester
3-(4-hydroxy-3-methoxyphenylthio)propionic acid 2-(4-hydroxy-3-methoxyphenylthio)ethyl ester
3-(3,4-dihydroxyphenylthio)propionic acid 2-(3,4-dihydroxyphenylthio)ethyl ester
oxalic acid bis[2-(4-hydroxyphenylthio)ethyl] ester
oxalic acid bis[2-(4-hydroxy-3-methylphenylthio)ethyl] ester
oxalic acid bis[2-(4-hydroxy-3-cyclohexylphenylthio)ethyl]ester
oxalic acid bis[2-(4-hydroxy-3-chlorophenylthio)ethyl] ester
oxalic acid bis[2-(4-hydroxy-3-allylphenylthio)ethyl] ester
oxalic acid bis[2-(3,4-dihydroxyphenylthio)ethyl] ester
malonic acid bis[2-(4-hydroxyphenylthio)ethyl] ester
malonic acid bis[2-(4-hydroxy-3-methoxylphenylthio)ethyl] ester
malonic acid bis[2-(4-hydroxy-3-chlorophenylthio)ethyl] ester
succinic acid bis[2-(4-hydroxyphenylthio)ethyl] ester
succinic acid bis[2-(4-hydroxy-3-methylphenylthio)ethyl] ester
succinic acid bis[2-(4-hydroxy-3-methoxyphenylthio)ethyl] ester
glutaric acid bis[2-(4-hydroxyphenylthio)ethyl] ester
ethylene glycol bis[(4-hydroxyphenylthio)acetate]
ethylene glycol bis[3-(4-hydroxyphenylthio)propionate]
ethylene glycol bis[(4-hydroxy-3-methylphenylthio)acetate]
ethylene glycol bis[3-(4-hydroxy-3-methylphenylthio)propionate]
ethylene glycol bis[(4-hydroxy-3-methoxyphenylthio)acetate]
ethylene glycol bis[3-(4-hydroxy-3-methoxyphenylthio)propionate]
ethylene glycol bis[(4-hydroxy-3-chlorophenylthio)acetate]
ethylene glycol bis[3-(4-hydroxy-3-chlorophenylthio)propionate]
propylene glycol bis[(4-hydroxyphenylthio)acetate]
propylene glycol bis[3-(4-hydroxyphenylthio)propionate]
propylene glycol bis[(4-hydroxy-3-cyclohexylphenylthio)acetate]
propylene glycol bis[3-(4-hydroxy-3-cyclohexylphenylthio)propionate]
1,3-propanediol bis[(4-hydroxyphenylthio)acetate]
1,3-propanediol bis[3-(4-hydroxyphenylthio)propionate]
1,3-propanediol bis[(4-hydroxy-3-allylphenylthio)acetate]
1,3-propanediol bis[3-(4-hydroxy-3-allylphenylthio)propionate]
1,3-propanediol bis[(4-hydroxy-3-ethoxyphenylthio)acetate]
1,3-propanediol bis[3-(4-hydroxy-3-ethoxyphenylthio)propionate]
1,4-butanediol bis[(4-hydroxyphenylthio)acetate]
1,4-butanediol bis[3-(4-hydroxyphenylthio)propionate]
1,4-butanediol bis[(4-hydroxy-3-methylphenylthio)acetate]
1,4-butanediol bis[3-(4-hydroxy-3-methylphenylthio)propionate]
1,4-butanediol bis[(4-hydroxy-3-chlorophenylthio)acetate]
1,4-butanediol bis[3-(4-hydroxy-3-chlorophenylthio)proprionate]
1,4-butanediol bis[(4-hydroxy-3-methoxyphenylthio)acetate]
1,4-butanediol bis[3-(4-hydroxy-3-methoxyphenylthio)propionate]
carbonic acid bis[2-(4-hydroxyphenylthio)ethyl] ester
carbonic acid bis[2-(4-hydroxy-3-chlorophenylthio)ethyl] ester
carbonic acid bis[2-(4-hydroxy-3-methoxyphenylthio)ethyl] ester
carbonic acid bis[2-(4-hydroxy-3-allylphenylthio)ethyl] ester
2-(4-hydroxyphenylthio)-N-[2-(4-hydroxyphenylthio)ethyl]acetamide
2-(4-hydroxyphenylthio)-N-[3-(4-hydroxyphenylthio)propyl]acetamide
2-(4-hydroxy-3-methylphenylthio)-N-[2-(4-hydroxy-3-methylphenylthio)ethyl]acetamide
2-(4-hydroxy-3-methylphenylthio)-N-[3-(4-hydroxy-3-methylphenylthio)propyl]acetamide
2-(4-hydroxy-3-chlorophenylthio)-N-[2-(4-hydroxy-3-chlorophenylthio)ethyl]acetamide
2-(4-hydroxy-3-chlorophenylthio)-N-[3-(4-hydroxy-3-chlorophenylthio)propyl]acetamide
2-(4-hydroxy-3-methoxyphenylthio)-N-[2-(4-hydroxy-3-methoxyphenylthio)ethyl]acetamide
2-(4-hydroxy-3-methoxyphenylthio)-N-[3-(4-hydroxy-3-methoxyphenylthio)propyl]acetamide
2-(4-hydroxy-3-cyclohexylphenylthio)-N-[3-(4-hydroxy-3-cyclohexylphenylthio)propyl]acetamide
2-(3,4-dihydroxyphenylthio)-N-[2-(3,4-dihydroxyphenylthio)ethyl]acetamide
2-(3,4-dihydroxyphenylthio)-N-[3-(3,4-dihydroxyphenylthio)propyl]acetamide
2-(2,4-dihydroxyphenylthio)-N-[2-(2,4-dihydroxyphenylthio)ethyl]acetamide
2-(2,4-dihydroxyphenylthio)-N-[3-(2,4-dihydroxyphenylthio)propyl]acetamide
2-(4-hydroxy-3-allylphenylthio)-N-[2-(4-hydroxy-3-allylphenylthio)ethyl]acetamide
2-(2-hydroxyphenylthio)-N-[2-(2-hydroxyphenylthio)ethyl]acetamide
2-(2-hydroxyphenylthio)-N-[3-(2-hydroxyphenylthio)propyl]acetamide
2-(4-hydroxyphenylthio)-N-[2-(4-hydroxyphenylthio)ethyl]propionamide
2-(4-hydroxyphenylthio)-N-[3-(4-hydroxyphenylthio)propyl]propionamide
3-(4-hydroxyphenylthio)-N-[2-(4-hydroxyphenylthio)ethyl]propionamide
3-(4-hydroxyphenylthio)-N-[3-(4-hydroxyphenylthio)propyl]propionamide
3-(4-hydroxy-3-methylphenylthio)-N-[2-(4-hydroxy-3-methylphenylthio)ethyl]propionamide
3-(4-hydroxy-3-chlorophenylthio)-N-[3-(4-hydroxy-3-chlorophenylthio)propyl]propionamide
3-(4-hydroxy-3-methoxyphenylthio)-N-[2-(4-hydroxy-3-methoxyphenylthio)ethyl]propionamide
3-(4-hydroxy-3-methoxyphenylthio)-N-[3-(4-hydroxy-3-methoxyphenylthio)propyl]propionamide
N,N'-bis[2-(4-hydroxyphenylthio)ethyl]oxamide N,N'-bis[3-(4-hydroxyphenylthio)propyl]oxamide
N,N'-bis[2-(4-hydroxy-3-methylphenylthio)ethyl]oxamide
N,N'-bis[3-(4-hydroxy-3-methylphenylthio)propyl]oxamide
N,N'-bis[2-(4-hydroxy-3-methoxyphenylthio)ethyl]oxamide
N,N'-bis[3-(4-hydroxy-3-chlorophenylthio)propyl]oxamide
N,N'-bis[2-(4-hydroxyphenylthio)ethyl]malonamide
N,N'-bis[3-(4-hydroxyphenylthio)propyl]malonamide
N,N'-bis[2-(4-hydroxyphenylthio)ethyl]succinamide
N,N'-bis[3-(4-hydroxyphenylthio)propyl]succinamide
N,N'-ethylenebis[(4-hydroxyphenylthio)acetamide]
N,N'-ethylenebis[3-(4-hydroxyphenylthio)propionamide]
N,N'-ethylenebis[(4-hydroxy-3-methylphenylthio)acetamide]
N,N'-ethylenebis[3-(4-hydroxy-3-methylphenylthio)-propionamide]
N,N'-ethylenebis[(4-hydroxy-3-ethylphenylthio)acetamide]
N,N'-ethylenebis[3-(4-hydroxy-3-ethylphenylthio)propionamide]
N,N'-ethylenebis[(4-hydroxy-3-methoxyphenylthio)acetamide]
N,N'-ethylenebis[3-(4-hydroxy-3-methoxyphenylthio)-propionamide]
N,N'-ethylenebis[(4-hydroxy-3-ethoxyphenylthio)acetamide]
N,N'-ethylenebis[3-(4-hydroxy-3-ethoxyphenylthio)-propionamide]
N,N'-trimethylenebis[(4-hydroxyphenylthio)acetamide]
N,N'-trimethylenebis[3-(4-hydroxyphenylthio)propionamide]
N,N'-trimethylenebis[(4-hydroxy-3-chlorophenylthio)acetamide]
N,N'-trimethylenebis[3-(4-hydroxy-3-chlorphenylthio)-propionamide]
N,N'-trimethylenebis[(4-hydroxy-3-allylphenylthio)acetamide]
N,N'-trimethylenebis[3-(4-hydroxy-3-allylphenylthio)-propionamide]
N,N'-tetramethylenebis[(4-hydroxyphenylthio)acetamide]
N,N'-tetramethylenebis[3-(4-hydroxyphenylthio)propionamide]
N,N'bis[2-(4-hydroxyphenylthio)ethyl]urea
N,N'bis[3-(4-hydroxyphenylthio)propyl]urea These compounds can be used in a mixture of at least two of them.

Among the compounds of the formula [I] preferable are the compounds wherein R is $$-R_3-\underset{\underset{O}{\|}}{C}-X-R_4-,\ -R_3-X-\underset{\underset{O}{\|}}{C}-R_5-\underset{\underset{O}{\|}}{C}-X-R_4-,$$

$$-R_3-\underset{\underset{O}{\|}}{C}-X-R_6-X-\underset{\underset{O}{\|}}{C}-R_4-\ \text{or}\ -R_3-X-\underset{\underset{O}{\|}}{C}-X-R_4-,$$

$R_3$, $R_4$ and $R_6$ are each an alkylene group, $R_5$ is a direct bond or an alkylene group and X is —O— or —NH—. $R_3$, $R_4$ and $R_6$ are each preferably $C_{1\sim4}$ straight-chain or branched-chain alkylene and $R_5$ is preferably $C_{1\sim4}$ straight-chain or branched-chain alkylene or direct bond. With these compounds, a recording material is obtained which is particularly excellent in color forming ability and free from fogging in white portion. More preferable is the compound wherein R is $$-R_3-\underset{\underset{O}{\|}}{C}-X-R_4-$$

which is relatively easily prepared and affords a recording material having excellent resistance to light of the record images.

Further, among the compounds of the formula [I] preferable are those having a melting point of at least 50° C. and more preferable are those having a melting point of 70° to 200° C.

The compound of the formula [I] can easily be prepared, for example, by a usual etherification reaction between a hydroxythiophenol derivative and a bifunctional compound such as dihaloalkane having a ester bond or amido bond in the main chain.

As a colorless or light-colored basic dye contained in the heat sensitive recording layer in the present invention are used various known basic dyes. Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(4-dimethylaminophenyl)-3-(4-dimethylamino-2-methylphenyl)-6-(dimethylamino)phthalide, 3-(p-dimethylaminophenyl)-3-(1,2-dimethylindole-3-yl)phthalide, 3-(p-dimethylaminophenyl)-b 3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Divinylphthalide-based dyes, e.g., 3,3-bis[1,1-bis(4-pyrrolidinophenyl)ethylene-2-yl]-4,5,6,7-tetrabromophthalide, 3,3-bis[1-(4-methoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methyllfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-diethylamino-fluoran, 4-benzylamino-8-diethylaminobenzo[a]fluoran, 3-[4-(4-dimethylaminoanilino)anilino]-7-chloro-6-methylfluoran, 8-[4-(4-dimethylaminoanilino)anilino]-benzo[a]fluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-ethyl-N-isoanylamino)-6-methyl-7-phenylaminofluoran, 3-(N-cyclohexyl-N-methylamino)-6-methyl-7-phenylamino-fluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-(N-ethyl-N-tetrahydrofurfurylamino)-6-methyl-7-phenylaminofluoran, 3-(N-methyl-N-n-propylamino)-6-methyl-7-phenylamino-fluoran, 3-(N-ethyl-N-isobutylamino)-6-methyl-7-phenylaminofluoran, 3-(N-methyl-N-n-hexylamino)-6-methyl-7-phenylaminofluoran, 3-(N-ethyl-N-n-hexylamino)-6-methyl-7-phenylaminofluoran, 3-(N-ethyl-N-cyclopentylamino)-6-methyl-7-phenylaminofluoran, etc.

Fluorene-based dyes, e.g., 3,6-bis(dimethylamino)-fluorene-9-spiro-3'-(6'-dimethylamino)phthalide, 3-diethylamino-6-(N-allyl-N-methylamino)fluorene-9-spiro-3'-(6'-dimethylamino)phthalide, 3,6-bis(dimethylamino)-spiro[fluorene-9,6'-6'H-chromeno(4,3-b)indole], 3,6-bis(dimethylamino)-3'-methyl-spiro[fluorene-9,6'-6'H-chromeno(4,3-b)indole], 3,6-bis(diethylamino)-3'-methyl-spiro[fluorene-9,6'-6'H-chromeno(4,3-b)indole], etc. These basic dyes are not limited to thereabove and can be used, as required, in a mixture of at least two of them.

The proportions of the color acceptor having the above specific structure and the basic dye are not necessarily limited but usually 100 to 700 parts by weight, preferably 150 to 600 parts by weight, of the color acceptor is used per 100 parts by weight of the basic dye.

For preparing a coating composition comprising the foregoing components, the basic dye and the color acceptor are dispersed, together or individually, into water serving as a dispersion medium, using stirring and pulverizing means such as a ball mill, attritor or sand mill. Usually the coating composition has incorporated therein a binder in an amount of 10 to 40% by weight, preferably 15 to 30% by weight, based on the total solids content of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc.

Various other auxiliary agents can be further added to the coating composition. Examples of useful agents are dispersants such as sodium dioctyl sulfosuccinate, sodium dodecylbenzenesulfonate, sodium laurylsulfate, fatty acid metal salts, etc., ultraviolet absorbers such as triazole compounds, defoaming agents, fluorescent dyes, coloring dyes, etc. Further, to the composition may be added, in order to prevent sticking upon contact of the heat sensitive recording material with a recording device or thermal head, a dispersion or emulsion of stearic acid, polyethylene, carnauba wax, paraffin wax, zinc stearate, calcium stearate, ester wax or the like.

In addition, to the composition may be added in order to prevent the adhesion of tailings to the thermal head, inorganic pigment such as kaolin, clay, talc, calcium carbonate, calcined clay, titanium oxide, kieselguhr, finely divided anhydrous silica, activated clay, etc.

Further, various known heat-fusible substances may be added to the composition in an amount which does not cause adverse effect. Examples of useful heat-fusible substances are the compounds of the following formulae [II] to [VIII].

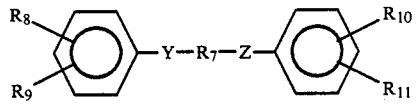

(II)

wherein $R_7$ is a divalent group of 2 to 8 carbon atoms, $R_8$ to $R_{11}$ are each hydrogen atom, lower alkyl, cycloalkyl, phenyl, lower alkoxyl, cycloalkoxyl, lower alkylthio, aralkyloxy, aralkylthio, lower alkyloxycarbonyl, aralkyloxycarbonyl or halogen atom, $R_8$ and $R_9$, or $R_{10}$ and $R_{11}$ may link to form aromatic ring, Y and Z are each oxygen atom or sulfur atom.

Preferred examples of $R_7$ are alkylene or alkylene having halogen atom, ether bond, thioether bond and unsaturated bond. More preferable examples of $R_7$ are alkylene and alkylene having ether bond.

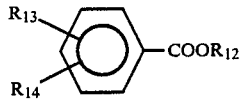

(III)

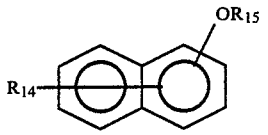

(IV)

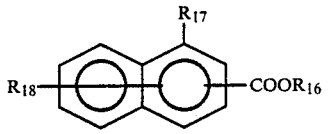

(V)

wherein $R_{12}$, $R_{15}$ and $R_{16}$ are each alkyl, aryl or aralkyl, which may have substituent(s); and preferably are $C_{1\sim24}$ alkyl group; phenyl group which may have lower alkyl, lower alkoxyl, halogen atom, lower alkyloxycarbonyl or aralkyloxycarbonyl group; or benzyl group which may have lower alkyl, lower alkoxyl, halogen atom, lower alkyloxycarbonyl or aralkyloxycarbonyl group, $R_{13}$ and $R_{14}$ are each hydrogen atom, halogen atom, lower alkyl, lower alkoxyl, aralkyloxy, lower alkyloxycarbonyl or aralkyloxycarbonyl, $R_{17}$ is hydrogen atom or hydroxyl, $R_{18}$ is hydrogen atom, halogen atom, lower alkyl, lower alkyloxycarbonyl or aralkyloxycarbonyl, $R_{19}$ is $C_{1\sim24}$ alkyl or $C_{2\sim24}$ alkenyl, $R_{20}$ and $R_{21}$ are each hydrogen atom, $C_{1\sim24}$ alkyl, $C_{2\sim24}$ alkenyl or phenyl, $R_{22}$ and $R_{23}$ are each benzyl group which may have lower alkyl, lower alkoxyl or halogen atom.

Among the heat-fusible substances of the above formulae [II] to [VIII] preferable are those having a melting point of 60° to 200° C. and more preferable are those having a melting point of 70° to 150° C.

Examples of these substances are as follows: 1,2-Diphenoxyethane, 1,2-bis(2-methylphenoxy)ethane, 1,2-bis(3-methylphenoxy)ethane, 1,2-bis(4-methylphenoxy)ethane, 1-phenoxy-2-(2-methylphenoxy)ethane, 1-phenoxy-2-(3-methylphenoxy)ethane, 1-phenoxy-2-(4-methylphenoxy)ethane, 1-phenoxy-2-(4-ethylphenoxy)ethane, 1-phenoxy-2-(4-isopropylphenoxy)ethane, 1-phenoxy-2-(4-tert-butylphenoxy)ethane, 1-phenoxy-2-(2,3-dimethylphenoxy)ethane, 1-phenoxy-2-(2,4-dimethylphenoxy)ethane, 1-phenoxy-2-(3,4-dimethylphenoxy)ethane, 1-phenoxy-2-(3,5-dimethylphenoxy)ethane, 1-(2-methylphenoxy)-2-(4-methylphenoxy)ethane, 1-(3-methylphenoxy)-2-(4-methylphenoxy)ethane, 1-phenoxy-2-(2-phenylphenoxy)ethane, 1-phenoxy-2-(4-methoxyphenoxy)ethane, 1-(2-methylphenoxy)-2-(4-methoxyphenoxy)ethane, 1-(2-chlorophenoxy)-2-(4-methoxyphenoxy)ethane, 1-(3-methylphenoxy)-2-(4-methoxyphenoxy)ethane, 1-(4-methylphenoxy)-2-(4-methoxyphenoxy)ethane, 1-(2,4-dimethylphenoxy)-2-(4-methoxyphenoxy)ethane, 1-phenoxy-2-(α-naphthyloxy)ethane, 1-phenoxy-2-(2-chlorophenoxy)ethane, 1-phenoxy-2-(3-chlorophenoxy)ethane, 1-phenoxy-2-(4-chlorophenoxy)ethane, 1,2-bis(2-chlorophenoxy)ethane, 1,2-bis(3-chlorophenoxy)ethane, 1,2-bis(4-chlorophenoxy)ethane, 1,3-bis(4-methoxyphenoxy)propane, 1-phenoxy-3-(β-naphthyloxy)propane, 1-(4-methylphenoxy)-3-(β-naphthyloxy)propane, 1-phenoxy-3-(4-phenylphenoxy)propane, 1-(4-methylphenoxy)-3-(4-phenylphenoxy)propane, 1,4-diphenoxybutane, 1,4-bis(4-methylphenoxy)butane, 1,4-bis(4-methoxyphenoxy)butane, 1,4-bis(4-cyclohexylphenoxy)butane, 1,4-bis(4-chlorophenoxy)butane, 1,4-bis(2-methylphenoxy)butane, 1,6-diphenoxyhexane, 1-phenoxy-6-(β-naphthyloxy)hexane, 1,2-bis[4-methylthio)phenoxy]ethane, 1,3-bis[4-(methylthio)phenoxy]propane, 1,4-bis[4-(methylthio)phenoxy]butane, 1,2-bis[4-benzylthio)phenoxy]ethane, 1,2-bis(4-benzyloxyphenoxy)ethane, 1,2-bis(4-methoxycarbonylphenoxy)ethane, 1,2-bis(4-ethoxycarbonylphenoxy)ethane, 1,2-bis(4-benzyloxycarbonylphenoxy)ethane, 1,5-bis(4-methoxyphenoxy)-3-oxapentane, 1,5-bis[4-(methylthio)phenoxy]-3-oxapentane, 1,5-bis(4-methoxyphenoxy)-3-thiapentane, 1,5-bis[4-(methylthio)phenoxy]-3-thiapentane, 1,3-diphenoxy-2-chloropropane, 1,4-diphenoxy-2-chlorobutane, 1,4-diphenoxy-2-butene, 1,4-diphenoxy-2-butyne, 1,2-bis(phenylthio)ethane, 1,3-bis(phenylthio)propane, 1,4-bis(phenylthio)butane, 1,2-bis(4-chlorophenylthio)ethane, 1,3-bis(4-chlorophenylthio)propane, 1,4-bis(4-chlorophenylthio)butane, 1,2-bis(4-methylphenylthio)ethane, 1,3-bis(4-methylphenylthio)propane, 1,4-bis(4-methylphenylthio)butane, 1,2-bis(4-methoxyphenylthio)ethane, 1,3-bis(4-methoxyphenylthio)propane, 1,4-bis(4-methoxyphenylthio)butane, 1,5-bis(4-methoxyphenylthio)-3-oxapentane, 1,3-bis(phenylthio)acetone, 1-phenoxy-2-(phenylthio)ethane, 1-phenoxy-4-(phenylthio)butane, 1-phenoxy-2-(4-methylphenylthio)ethane, 1-phenoxy-2-(4-chlorophenylthio)ethane, 1-phenoxy-2-(4-methoxyphenylthio)ethane; dimethyl isophthalate, dimethyl terephthalate, dibenzyl isophthalate, dibenzyl terephthalate, p-benzyloxybenzoic acid methyl ester, p-benzyloxybenzoic acid benzyl ester, 4-(p-chlorobenzyloxy)benzoic acid p-chlorobenzyl ester, 4-(p-methylbenzyloxy)benzoic acid p-methylbenzyl ester; 1-benzyloxynaphthalene, 2-benzyloxynaphthalene, 2-(p-chlorobenzyloxy)-naphthalene, 2-(p-methylbenzyloxy)naphthalene, 2-(p-methoxybenzyloxy)naphthalene, 2-dodecyloxynaphthalene; 6-benzyloxy-2-naphthoic acid benzyl ester, 4-benzyloxy-1-naphthoic acid benzyl ester, 1-hydroxy-2-naphthoic acid phenyl ester, 2-naphthoic acid phenyl ester; 1,2-bis(2-vinyloxyethoxy)benzene, 1,4-bis(2-vinyloxyethoxy)benzene, 2,5-bis(2-vinyloxyethoxy)toluene, 3,5-bis(2-vinyloxyethoxy)toluene, 1-tert-butyl-2,5-bis(2-vinyloxyethoxy)benzene, 1,4-di-tert-butyl-2,5-bis(2-vinyloxyethoxy)benzene; caproic acid amide, capric acid amide, palmitic acid amide, stearic acid amide, oleic acid amide, erucic acid amide, linoleic amide, linolenic acid amide, N-methylstearic acid amide, stearic acid anilide, N-methyloleic acid amide, N-ethylcapric acid amide, linoleic acid anilide, benzanilide, N-butyllauric acid amide, N-octadecylacetamide, N-oleylacetamide, N-oleylbenzamide, N-stearylcyclohexylamide; dibenzyl oxalate, oxalic acid bis(p-methylbenzyl) ester, oxalic acid bis(p-chlorobenzyl) ester.

The heat-fusible substance is not limited to thereabove and can be used, as required, in a mixture of at leas two of them.

The amount of the heat-fusible substance is not particularly limited and is usually 50 to 700 parts by weight, preferably 100 to 500 parts by weight per 100 parts by weight of the basic dye.

Further, it is preferable to add to the heat sensitive recording layer at least one phenolic compound of the formulae [IX] to [XII] which makes the record image more stable.

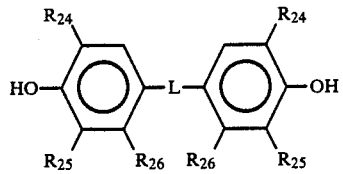

(IX)

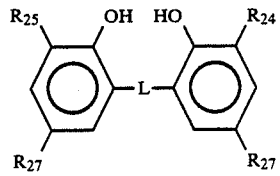

(X)

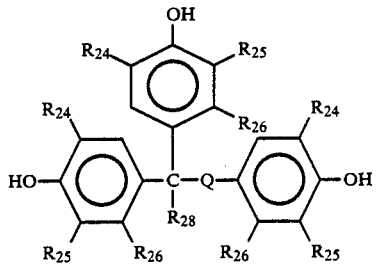

(XI)

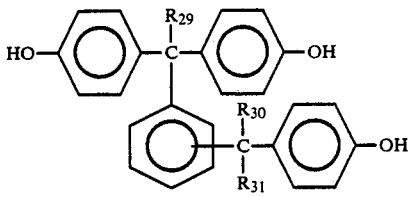

(XII)

wherein $R_{24}$ is $C_{3\sim8}$ branched-chain alkyl, cycloalkyl, phenyl or halogen atom, $R_{25}$ is hydrogen atom, $C_{3\sim8}$ branched-chain alkyl or halogen atom, $R_{26}$ and $R_{28}$ to $R_{31}$ are each hydrogen atom or lower alkyl, $R_{27}$ is hydrogen atom, halogen atom or $C_{1\sim8}$ alkyl, L or —O—, —S—, —S—S—, —$SO_2$— or

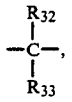

$R_{32}$ and $R_{33}$ are each hydrogen atom or $C_{1\sim8}$ alkyl, and may link to form a ring, Q is $C_{1\sim8}$ straight-chain or branched-chain alkylene.

Examples of the compounds of the formulae [IX] to [XII] are as follows. 4,4'-Butylidenebis(2-tert-butyl-5-methylphenol), 4,4'-butylidenebis(2-tert-butyl-6-methylphenol), 4,4'-butylidenebis(2,6-di-tert-butylphenol), 4,4'-butylidenebis(2-cyclohexylphenol), 4,4'-butylidenebis(2-phenylphenol), 4,4'-cyclohexylidenebis(2-tert-butyl-5-methylphenol), 4,4'-cyclohexylidenebis(2-tert-butyl-6-methylphenol), 4,4'-cyclohexylidenebis(2,6-di-tert-butylphenol), 4,4'-cyclohexylidenebis(2-cyclohexylphenol), 4,4'-cyclohexylidenebis(2-phenylphenol), 4,4'-thiobis(2-tert-butyl-5-methylphenol), 4,4'-thiobis(2-tert-butyl-6-methylphenol), 4,4'-thiobis(2,6-di-tert-butylphenol), 4,4'-thiobis(2-cyclohexylphenol), 4,4'-thiobis(2-phenylphenol), 4,4'-isopropylidenebis(2,6-dichlorophenol), 4,4'-isopropylidenebis(2,6-dibromophenol), 4,4'-cyclohexylidenebis(2,6-dichlorophenol), 4,4'-cyclohexylidenebis(2,6-dibromophenol), bis(4-hydroxy-3,5-dichlorophenyl)sulfone, bis(4-hydroxy-3,5-dibromophenyl)sulfone, bis(4-hydroxy-3,5-dichlorophenyl)sulfide, bis(4-hydroxy-3,5-dibromophenyl)sulfide, bis(4-hydroxy-3,5-dichlorophenyl)ether, bis(4-hydroxy-3,5-dibromophenyl)ether, bis(4-hydroxy-3,5-dichlorophenyl)disulfide, bis(4-hydroxy-3,5-dibromophenyl)disulfide; 2,2'-methylenebis(4-methyl-6-tert-butylphenol), 2,2'-methylenebis(4-ethyl-6-tert-butylphenol), 2,2'-methylenebis(4,6-di-tert-butylphenol), 2,2'-methylenebis(4,6-dichlorophenol), 2,2'-ethylidenebis(4,6-di-tert-butylphenol), 2,2'-thiobis(4-methyl-6-tert-butylphenol), 2,2'-thiobis(4-ethyl-6-tert-butylphenol), 2,2'-thiobis(4,6-di-tert-butylphenol), 2,2'-dithiobis(4-methyl-6-tert-butylphenol), bis(2-hydroxy-3-tert-butyl-5-methylphenyl)sulfone, bis(2-hydroxy-3-tert-butyl-5-ethylphenyl)sulfone, bis(2-hydroxy-3,5-dichlorophenyl)sulfone; 1,1,3-tris(2-methyl-4-hydroxy-5-tert-butylphenyl)butane, 1,1,3-tris(3-methyl-4-hydroxy-5-tert-butylphenyl)butane, 1,1,3-tris(3,5-di-tert-butyl-4-hydroxyphenyl)butane, 1,1,3-tris(3,5-dichloro-4-hydroxyphenyl)butane, 1,1,3-tris(3,5-dibromo-4-hydroxyphenyl)butane, 1,1,3-tris(3-cyclohexyl-4-hydroxy-6-methylphenyl)butane, 1,1,3-tris(3-phenyl-4-hydroxyphenyl)butane, 2-methyl-1,1,3-tris(2-methyl-4-hydroxy-5-tert-butylphenyl)butane, 2-ethyl-1,1,3-tris(2-methyl-4-hydroxy-5-tert-butylphenyl)butane, 1,1,3-tris(2-methyl-4-hydroxy-5-tert-butylphenyl)hexane, 1,1,3-tris(2-methyl-4-hydroxy-5-tert-butylphenyl)heptane, 2-ethyl-1,1,3-tris(2-methyl-4-hydroxy-5-tert-butylphenyl)hexane; 1-[bis(4-hydroxyphenyl)methyl]-3-[1-(4-hydroxyphenyl)ethyl]benzene, 1-[bis(4-hydroxyphenyl)methyl]-4-[1-(4-hydroxyphenyl)ethyl]benzene, 1-[bis(4-hydroxyphenyl)methyl]-3-[1-methyl-1-(4-hydroxyphenyl)ethyl]benzene, 1-[bis(4-hydroxyphenyl)methyl]-4-[1-methyl-1-(4-hydroxyphenyl)ethyl]benzene, 1-[1,1-bis(4-hydroxyphenyl)ethyl]-3-[1-(4-hydroxyphenyl)ethyl]benzene, 1-[1,1-bis(4-hydroxyphenyl)ethyl]-4-[1-(4-hydroxyphenyl)ethyl]benzene, 1-[1,1-bis(4-hydroxyphenyl)ethyl]-3-[1-methyl-1-(4-hydroxyphenyl)ethyl]benzene, 1-[1,1-bis(4-hydroxyphenyl)ethyl]-4-[1-methyl-1-(4-hydroxyphenyl)ethyl]benzene, etc.

The compound of the above formulae [IX] to [XII] can be used, as required, in a mixture of at least two of them.

The amount of the phenolic compound having the above specific structure is not particularly limited and is usually 5 to 300 parts by weight, preferably 10 to 200 parts by weight per 100 parts by weight of the basic dye.

The present heat sensitive recording material is characterized in that at least one of the above specific compound of the formula [I] is used as a color acceptor. It is possible, however, to use conjointly other color acceptors such as bisphenol A, 4,4'-cyclohexylidenediphenol, benzyl 4-hydroxybenzoate, dimethyl 4-hydroxyphthalate, 4-hydroxy-4'-isopropoxydiphenylsulfone, complex of zinc thiocyanate with antipyrine, etc.

As a substrate (support) to be coated, may be used a paper, plastic film, synthetic fiber sheet or the like, but a paper is most preferably used from a viewpoint of cost, coating applicability, etc. The amount of coating composition forming the recording layer to be applied to the support, which is not limited particularly, is usually about 2 to 12 g/m$^2$, preferably about 3 to 10 g/m$^2$, based on dry weight.

Further, it is possible to form an over-coat layer on the recording layer to protect the layer. Various other known techniques in the field of heat sensitive recording material can be applied. For example, it is possible to form a protective layer on the rear surface of the support, to form a primary coating layer on the support.

The heat sensitive recording materials thus obtained are excellent in high-speed recording amenability, free from discoloring tendency of the record images and fogging in white portion of the recording material, and are also free from piling of residue on the thermal head.

The invention will be described below in more detail with reference to Examples by no means limited to, in which parts and percentages are all by weight, unless otherwise specified.

EXAMPLE 1

① Composition (A)

| | |
|---|---|
| 3-(N-Ethyl-N-isoamylamino)-6-methyl-7-phenylaminofluoran | 10 parts |
| 5% Aqueous solution of methyl cellulose | 10 parts |
| Water | 40 parts |

These components were pulverized by a sand mill to prepare Composition (A) having an average particle size of 3 μm.

② Composition (B)

| | |
|---|---|
| (4-Hydroxyphenylthio)acetic acid 2-(4-hydroxyphenylthio)ethyl ester | 40 parts |
| 5% Aqueous solution of methyl cellulose | 40 parts |
| Water | 80 parts |

These components were pulverized by a sand mill to prepare Composition (B) having an average particle size of 3 μm.

③ Formation of a recording layer

A coating composition was prepared by mixing with stirring 60 parts of Composition (A), 160 parts of Composition (B), 30 parts of finely divided anhydrous silica (oil absorption 180 ml/100 g), 150 parts of 20% aqueous solution of oxidized starch and 100 parts of water. To a paper substrate weighing 50 g/m$^2$ was applied and dried the above coating composition in an amount of 6.0 g/m$^2$ by dry weight to obtain a heat sensitive recording paper.

EXAMPLES 2 TO 11

Ten kinds of heat sensitive recording papers were prepared in the same manner as in Example 1 except that, in the preparation of Composition (B), the following compounds were used in place of (4-hydroxyphenylthio)acetic acid 2-(4-hydroxyphenylthio)ethyl ester.

Example 2; (4-hydroxyphenylthio)acetic acid 3-(4-hydroxyphenylthio)propyl ester

Example 3; (4-hydroxy-3-methoxyphenylthio)acetic acid 2-(4-hydroxy-3-methoxyphenylthio)ethyl ester Example 4; (4-hydroxy-3-chlorophenylthio)acetic acid 2-(4-hydroxy-3-chlorophenylthio)ethyl ester Example 5; 2-(4-hydroxyphenylthio)propionic acid 2-(4-hydroxyphenylthio)ethyl ester Example 6; oxalic acid bis[2-(4-hydroxyphenylthio)ethyl]ester Example 7; malonic acid bis[2-(4-hydroxyphenylthio)ethyl]ester Example 8; ethylene glycol bis[(4-hydroxyphenylthio)acetate]

Example 9; 1,3-propanediol bis[(4-hydroxyphenylthio)acetate]

Example 10; 1,4-butanediol bis[(4-hydroxyphenylthio)acetate]

Example 11; carbonic acid bis[2-(4-hydroxyphenylthio)ethyl]ester

EXAMPLE 12

① Composition (C)

| | |
|---|---|
| 3-Dibutylamino-6-methyl-7-phenylaminofluoran | 10 parts |
| 4,4'-Butylidenebis(2-tert-butyl-5-methylphenol) | 5 parts |
| 1,2-Bis(3-methylphenoxy)ethane | 20 parts |
| 5% Aqueous solution of methyl cellulose | 25 parts |
| Water | 100 parts |

These components were pulverized by a sand mill to prepare Composition (C) having an average particle size of 2 μm.

② Formation of a recording layer

A coating composition was prepared by mixing with stirring 80 parts of Composition (B) which was prepared in the same manner as in Example 1, 160 parts of Composition (C), 30 parts of finely divided anhydrous silica (oil absorption 180 ml/100 g), 150 parts of 20% aqueous solution of oxidized starch and 80 parts of water. To a paper substrate weighing 50 g/m$^2$ was applied and dried the above coating composition in an amount of 6.0 g/m$^2$ by dry weight to obtain a heat sensitive recording paper.

EXAMPLES 13 TO 15

Three kinds of heat sensitive recording papers were prepared in the same manner as in Example 12 except that, in the preparation of Composition (B), the following compounds were used in place of (4-hydroxyphenylthio)acetic acid 2-(4-hydroxyphenylthio)ethyl ester.

Example 13; (4-hydroxy-3-methylphenylthio)acetic acid 2-(4-hydroxy-3-methylphenylthio)ethyl ester Example 14; (4-hydroxy-3-methoxyphenylthio)acetic acid 2-(4-hydroxy-3-methoxyphenylthio)ethyl ester Example 15; (4-hydroxy-3-allylphenylthio)acetic acid 2-(4-hydroxy-3-allylphenylthio)ethyl ester

EXAMPLES 16 TO 22

Seven kinds of heat sensitive recording papers were prepared in the same manner as in Example 12 except that, in the preparation of Composition (C), the following compounds were used in place of 1,2-bis(3-methylphenoxy)ethane.

Example 16; 1,3-bis(4-methoxyphenoxy)propane

Example 17; dibenzyl terephthalate

Example 18; p-benzyloxybenzoic acid benzyl ester

Example 19; 2-benzyloxynaphthalene

Example 20; 1,4-bis(2-vinyloxyethoxy)benzene

Example 21; stearic acid amide

Example 22; oxalic acid bis(p-methylbenzyl) ester

EXAMPLE 23

① Composition (D)

| | |
|---|---|
| 3-Dibutylamino-6-methyl-7-phenylaminofluoran | 10 parts |
| 1,2-Bis(3-methylphenoxy)ethane | 20 parts |
| 5% Aqueous solution of methyl cellulose | 25 parts |
| Water | 105 parts |

These components were pulverized by a sand mill to prepare Composition (D) having an average particle size of 2 μm.

② Formation of a recording layer

A coating composition was prepared by mixing with stirring 80 parts of Composition (B) which was prepared in the same manner as in Example 1, 160 parts of Composition (D), 30 parts of finely divided anhydrous silica (oil absorption 180 ml/100 g), 150 parts of 20% aqueous solution of oxidized starch and 80 parts of water. To a paper substrate weighing 50 g/m$^2$ was applied and dried the above coating composition in an amount of 6.0 g/m$^2$ by dry weight to obtain a heat sensitive recording paper.

EXAMPLES 24 TO 26

Three kinds of heat sensitive recording papers were prepared in the same manner as in Example 23 except that, in the preparation of Composition (B), the following compounds were used in place of (4-hydroxyphenylthio)acetic acid 2-(4-hydroxyphenylthio)ethyl ester.

Example 24; (4-hydroxy-3-methylphenylthio)acetic acid 2-(4-hydroxy-3-methylphenylthio)ethyl ester Example 25; (4-hydroxy-3-methylphenylthio)acetic acid 2-(4-hydroxy-3-methoxyphenylthio)ethyl ester Example 26; (4-hydroxy-3-allylphenylthio)acetic acid 2(4-hydroxy-3-allylphenylthio)ethyl ester

COMPARISON EXAMPLES 1 AND 2

Two kinds of heat sensitive recording papers were prepared in the same manner as in Example 1 except that, in the preparation of Composition (B), the following compounds were used in place of (4-hydroxyphenylthio)acetic acid 2-(4-hydroxyphenylthio)ethyl ester.

Comparison Example 1; bisphenol A

Comparison Example 2; p-hydroxybenzoic acid benzyl ester

COMPARISON EXAMPLES 3 AND 4

Two kinds of heat sensitive recording papers were prepared in the same manner as in Example 1 except that, in the preparation of Composition (B), the following compounds were used in place of (4-hydroxyphenylthio)acetic acid 2-(4-hydroxyphenylthio)ethyl ester.

Comparison Example 3; 1,3-bis(4-hydroxyphenylthio)-2-propanone

Comparison Example 4; 1,5-bis(4-hydroxyphenylthio)-3-oxapentane

Each of 30 kinds of the heat sensitive recording materials thus obtained was fed to a thermal facsimile system (Hitachi HIFAX-400 Model) and a test chart was supplied for recording and checked for color density of the record image (recording density) and color density of white portion by Macbeth densitometer (Model RD-100R, with an amber filter). Table 1 shows the results.

Further, the above heat sensitive recording papers with or without the record images were allowed to stand at a high temperature and dry state of 60° C. for 24 hours, or at a high humidity state of 40° C. and 90% RH for 24 hours and then similarly checked for color density in white portion and the record image by Macbeth densitometer to evaluate preservabilities in white portion of the recording material and in the record images. Table 1 shows the results.

Further, the whiteness of the surface of the recording layer before recording was measured with use of a Hunter multipurpose reflectometer. The results are given in Table 1.

EXAMPLE 27

① Composition (E)

| | |
|---|---|
| 3-(N-Ethyl-N-isoamylamino)-6-methyl-7-phenylaminofluoran | 10 parts |
| 1,2-Bis(3-methylphenoxy)ethane | 20 parts |
| 5% Aqueous solution of methyl cellulose | 15 parts |
| Water | 120 parts |

These components were pulverized by a sand mill to prepare Composition (E) having an average particle size of 3 μm.

② Composition (F)

| | |
|---|---|
| 2-(4-Hydroxyphenylthio)-N-[2-(4-hydroxyphenylthio)ethyl]acetamide | 30 parts |
| 5% Aqueous solution of methyl cellulose | 30 parts |
| Water | 70 parts |

These components were pulverized by a sand mill to prepare Composition (F) having an average particle size of 3 μm.

③ Formation of a recording layer

A coating composition was prepared by mixing with stirring 165 parts of Composition (E), 130 parts of Composition (F), 30 parts of finely divided anhydrous silica (oil absorption 180 ml/100 g), 150 parts of 20% aqueous solution of oxidized starch and 55 parts of water. To a paper substrate weighing 50 g/m$^2$ was applied and dried the above coating composition in an amount of 6.0 g/m$^2$ by dry weight to obtain a heat sensitive recording paper.

EXAMPLE 28 TO 42

Fifteen kinds of heat sensitive recording papers were prepared in the same manner as in Example 27 except that, in the preparation of Composition (F), the following compounds were used in place of 2-(4-hydroxyphenylthio)-N-[2-(4-hydroxyphenylthio)ethyl]acetamide.

Example 28; 2-(4-hydroxyphenylthio)-N-[3-(4-hydroxyphenylthio)propyl]acetamide

Example 29; 2-(4-hydroxy-3-methylphenylthio)-N-[2-(4-hydroxy-3-methylphenylthio)ethyl]acetamide Example 30; 2-(4-hydroxy-3-chlorophenylthio)-N-[2-(4-hydroxy-3-chlorophenylthio)ethyl]acetamide Example 31; 3-(4-hydroxyphenylthio)-N-[3-(4-hydroxyphenylthio)propyl]propionamide Example 32; 2-(4-hydroxy-3-cyclohexylphenylthio)-N-[3-(4-hydroxy-3-cyclohexylphenylthio)propyl]acetamide Example 33; 2-(3,4-dihydroxyphenylthio)-N-[2-(3,4-dihydroxyphenylthio)ethyl]acetamide Example 34; 2-(4-hydroxy-3-allylphenylthio)-N-[2-(4-hydroxy-3-allylphenylthio)ethyl]acetamide Example 35; 3-(4-hydroxyphenylthio)-N-[2-(4-hydroxyphenylthio)ethyl]propionamide Example 36; 3-(4-hydroxy-3-methoxyphenylthio)-N-[2-(4-hydroxy-3-methoxyphenylthio)ethyl]propionamide Example 37; N,N'-bis[2-(4-hydroxyphenylthio)ethyl]oxamide Example 38; N,N'-bis]2-(4-hydroxyphenylthio)ethyl]malonamide Example 39; N,N'-bis[2-(4-hydroxyphenylthio)ethyl]succinamide Example 40; N,N'-ethylenebis[(4-hydroxyphenylthio)acetamide]

Example 41; N,N'-trimethylbenebis[(4-hydroxyphenylthio)acetamide]

Example 42; N,N'-bis[2-(4-hydroxyphenylthio)ethyl]urea

COMPARISON EXAMPLE 5

A heat sensitive recording paper was prepared in the same manner as in Example 27 except that, in the preparation of Composition (F), bisphenol A was used in place of 2-(4-hydroxyphenylthio)-N-[2-(4-hydroxyphenylthio)ethyl]acetamide.

Each of seventeen kinds of the heat sensitive recording materials thus obtained was fed to a thermal facsimile system (Hitachi HIFAX-700 Model) and a test chart was supplied for recording and checked for color density of the record image (recording density) and color density of white portion of the recording material in the same manner as in Examples 1 to 26. Table 2 shows the results.

Further, the above heat sensitive recording papers with or without the record images were allowed to stand at a high temperature and dry state of 60° C. for 24 hours, or at a high humidity state of 40° C. and 90% RH for 24 hours and then similarly checked for color density in white portion and the record image by Macbeth densitometer to evaluate preservabilities in white portion of the recording material and in the record images. Table 2 shows the results (The larger the value, the higher the recording density, and the smaller the value of white portion, the lesser the fogging.).

Further, the whiteness of the surface of the recording layer before recording was measured with use of a Hunter multipurpose reflectometer. The results are given in Table 2.

As apparent from Table 1 and 2, the heat sensitive recording material of the present invention is excellent in whiteness, high-speed recording amenability and preservabilities in white portion of the recording material and in the record images.

We claim:

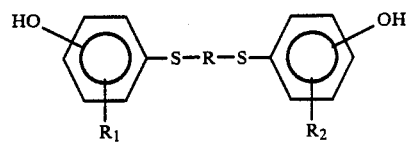

(I)

TABLE 1

| | Recording density | Preservability in white portion | | | Preservability in record image | | | Whiteness (%) |
|---|---|---|---|---|---|---|---|---|
| | | untreated | heat-treated | humidity-treated | untreated | heat-treated | humidity-treated | |
| Ex. 1 | 1.39 | 0.05 | 0.09 | 0.06 | 1.39 | 1.35 | 1.31 | 84.2 |
| Ex. 2 | 1.34 | 0.05 | 0.08 | 0.06 | 1.34 | 1.32 | 1.27 | 84.3 |
| Ex. 3 | 1.35 | 0.05 | 0.08 | 0.05 | 1.35 | 1.33 | 1.29 | 84.5 |
| Ex. 4 | 1.33 | 0.05 | 0.08 | 0.06 | 1.33 | 1.28 | 1.23 | 84.2 |
| Ex. 5 | 1.38 | 0.05 | 0.09 | 0.06 | 1.38 | 1.31 | 1.25 | 84.3 |
| Ex. 6 | 1.37 | 0.05 | 0.08 | 0.06 | 1.37 | 1.33 | 1.24 | 84.0 |
| Ex. 7 | 1.37 | 0.05 | 0.09 | 0.06 | 1.37 | 1.30 | 1.24 | 84.2 |
| Ex. 8 | 1.36 | 0.05 | 0.08 | 0.06 | 1.36 | 1.28 | 1.23 | 84.3 |
| Ex. 9 | 1.38 | 0.05 | 0.09 | 0.06 | 1.38 | 1.31 | 1.25 | 84.2 |
| Ex. 10 | 1.37 | 0.05 | 0.08 | 0.05 | 1.37 | 1.29 | 1.23 | 84.2 |
| Ex. 11 | 1.38 | 0.05 | 0.09 | 0.06 | 1.38 | 1.31 | 1.32 | 83.9 |
| Ex. 12 | 1.44 | 0.05 | 0.10 | 0.06 | 1.44 | 1.34 | 1.23 | 84.6 |
| Ex. 13 | 1.41 | 0.05 | 0.09 | 0.05 | 1.41 | 1.31 | 1.21 | 84.8 |
| Ex. 14 | 1.42 | 0.05 | 0.09 | 0.05 | 1.42 | 1.33 | 1.22 | 84.5 |
| Ex. 15 | 1.40 | 0.05 | 0.09 | 0.05 | 1.40 | 1.32 | 1.21 | 84.5 |
| Ex. 16 | 1.43 | 0.05 | 0.10 | 0.06 | 1.43 | 1.33 | 1.20 | 84.6 |
| Ex. 17 | 1.42 | 0.05 | 0.09 | 0.06 | 1.42 | 1.30 | 1.20 | 84.4 |
| Ex. 18 | 1.42 | 0.05 | 0.10 | 0.06 | 1.42 | 1.32 | 1.22 | 84.1 |
| Ex. 19 | 1.43 | 0.06 | 0.10 | 0.06 | 1.43 | 1.31 | 1.23 | 84.2 |
| Ex. 20 | 1.43 | 0.06 | 0.09 | 0.06 | 1.43 | 1.28 | 1.21 | 84.3 |
| Ex. 21 | 1.40 | 0.06 | 0.11 | 0.07 | 1.40 | 1.30 | 1.24 | 84.0 |
| Ex. 22 | 1.41 | 0.05 | 0.10 | 0.06 | 1.41 | 1.27 | 1.20 | 84.2 |
| Ex. 23 | 1.43 | 0.05 | 0.08 | 0.05 | 1.43 | 1.31 | 1.20 | 84.7 |
| Ex. 24 | 1.41 | 0.05 | 0.08 | 0.05 | 1.41 | 1.28 | 1.21 | 84.8 |
| Ex. 25 | 1.41 | 0.05 | 0.08 | 0.05 | 1.41 | 1.30 | 1.20 | 84.6 |
| Ex. 26 | 1.39 | 0.05 | 0.08 | 0.05 | 1.39 | 1.28 | 1.20 | 84.6 |
| Com. Ex. 1 | 0.72 | 0.07 | 0.17 | 0.15 | 0.72 | 0.64 | 0.59 | 82.7 |
| Com. Ex. 2 | 1.24 | 0.05 | 0.09 | 0.06 | 1.24 | 0.64 | 0.51 | 84.0 |
| Com. Ex. 3 | 1.35 | 0.12 | 0.73 | 0.22 | 1.35 | 1.32 | 1.20 | 76.9 |
| Com. Ex. 4 | 1.35 | 0.06 | 0.14 | 0.07 | 1.35 | 1.20 | 1.14 | 83.4 |

TABLE 2

| | Recording density | Preservability in white portion | | | Preservability in record image | | | Whiteness (%) |
|---|---|---|---|---|---|---|---|---|
| | | untreated | heat-treated | humidity-treated | untreated | heat-treated | humidity-treated | |
| Ex. 27 | 1.37 | 0.05 | 0.10 | 0.06 | 1.37 | 1.24 | 1.20 | 84.5 |
| Ex. 28 | 1.35 | 0.05 | 0.09 | 0.06 | 1.35 | 1.22 | 1.15 | 84.7 |
| Ex. 29 | 1.37 | 0.05 | 0.08 | 0.06 | 1.37 | 1.23 | 1.16 | 85.0 |
| Ex. 30 | 1.33 | 0.05 | 0.09 | 0.06 | 1.33 | 1.20 | 1.14 | 84.9 |
| Ex. 31 | 1.36 | 0.05 | 0.09 | 0.06 | 1.36 | 1.24 | 1.19 | 84.8 |
| Ex. 32 | 1.35 | 0.05 | 0.08 | 0.05 | 1.35 | 1.20 | 1.14 | 84.9 |
| Ex. 33 | 1.37 | 0.05 | 0.10 | 0.07 | 1.37 | 1.25 | 1.21 | 84.4 |
| Ex. 34 | 1.34 | 0.05 | 0.08 | 0.06 | 1.34 | 1.22 | 1.17 | 84.8 |
| Ex. 35 | 1.36 | 0.05 | 0.09 | 0.06 | 1.36 | 1.23 | 1.20 | 84.6 |
| Ex. 36 | 1.34 | 0.05 | 0.08 | 0.06 | 1.34 | 1.21 | 1.15 | 84.6 |
| Ex. 37 | 1.34 | 0.05 | 0.09 | 0.06 | 1.34 | 1.22 | 1.17 | 84.8 |
| Ex. 38 | 1.35 | 0.05 | 0.08 | 0.06 | 1.35 | 1.20 | 1.15 | 84.7 |
| Ex. 39 | 1.35 | 0.05 | 0.08 | 0.06 | 1.35 | 1.20 | 1.13 | 84.8 |
| Ex. 40 | 1.36 | 0.05 | 0.08 | 0.06 | 1.36 | 1.24 | 1.21 | 84.5 |
| Ex. 41 | 1.36 | 0.05 | 0.09 | 0.06 | 1.36 | 1.23 | 1.20 | 84.5 |
| Ex. 42 | 1.34 | 0.05 | 0.08 | 0.06 | 1.34 | 1.21 | 1.13 | 85.1 |
| Com. Ex. 5 | 1.26 | 0.07 | 0.16 | 0.15 | 1.26 | 0.93 | 0.71 | 83.3 |

1. A heat sensitive recording material comprising a substrate and a heat sensitive recording layer thereon incorporating a colorless or light-colored basic dye and a color acceptor reactive with the dye to form a color when contacted therewith, the recording material being characterized in that, as the color acceptor is used at least one compound of the formula [I] wherein R is an alkylene group having at least one bond selected from the group consisting of ester bond and amido bond in the main chain, $R_1$ and $R_2$ are each hydrogen atom, alkyl, cycloalkyl, alkenyl, alkoxyl, hydroxyl or halogen atom.

2. A heat sensitive recording material as defined in claim 1 wherein R has 3 to 20 carbon atoms.

3. A heat sensitive recording material as defined in claim 1 wherein $R_1$ and $R_2$ are each hydrogen atom, $C_{1\sim4}$ alkyl, $C_{5\sim10}$ cycloalkyl, $C_{3\sim8}$ alkenyl, $C_{1\sim4}$ alkoxyl, hydroxyl, fluorine atom, chlorine atom or bromine atom.

4. A heat sensitive recording material as defined in claim 1 wherein R is $$-R_3-\underset{\underset{O}{\|}}{C}-X-R_4-,\quad -R_3-X-\underset{\underset{O}{\|}}{C}-R_5-\underset{\underset{O}{\|}}{C}-X-R_4-,$$

$$-R_3-\underset{\underset{O}{\|}}{C}-X-R_6-X-\underset{\underset{O}{\|}}{C}-R_4- \text{ or } -R_3-X-\underset{\underset{O}{\|}}{C}-X-R_4-,$$

$R_3$, $R_4$ and $R_6$ are each an alkylene group, $R_5$ is a direct bond or an alkylene group and X is —O— or —NH—.

5. A heat sensitive recording material as defined in claim 4 wherein R is $$-R_3-\underset{\underset{O}{\|}}{C}-X-R_4-,$$

$R_3$, $R_4$ and X are as defined above.

6. A heat sensitive recording material as defined in claim 4 wherein $R_3$, $R_4$ and $R_5$ are each $C_{1\sim4}$ straight-chain or branched-chain alkylene and $R_5$ is $C_{1\sim4}$ straight-chain or branched-chain alkylene or direct bond.

7. A heat sensitive recording material as defined in claim 1 wherein, in the compound of the formula [I], the hydroxyl groups are each in the para position to the sulfide bond.

8. A heat sensitive recording material as defined in claim 1 wherein the compound of the formula [I] has a melting point of at least 50° C.

9. A heat sensitive recording material as defined in claim 8 wherein the compound of the formula [I] has a melting point of 70° to 200° C.

10. A heat sensitive recording material as defined in claim 1 wherein the compound of the formula [I] is used in an amount of 100 to 700 parts by weight per 100 parts by weight of the basic dye.

* * * * *